United States Patent [19]

Kern et al.

[11] Patent Number: 4,785,292

[45] **Date of Patent: * Nov. 15, 1988**

[54] DUAL SPECTRUM FREQUENCY RESPONDING FIRE SENSOR

[75] Inventors: Mark T. Kern, Goleta; Kenneth A. Shamordola, Santa Barbara, both of Calif.

[73] Assignee: Santa Barbara Research Center, Goleta, Calif.

[ * ] Notice: The portion of the term of this patent subsequent to Sep. 1, 2001 has been disclaimed.

[21] Appl. No.: 13,576

[22] Filed: Feb. 11, 1987

Related U.S. Application Data

[63] Continuation of Ser. No. 592,611, Mar. 23, 1984, Pat. No. 4,691,196.

[51] Int. Cl.[4] ..... G08B 17/12

[52] U.S. Cl. ..... 340/578; 250/339

[58] Field of Search ..... 340/578, 577, 600; 250/339, 554; 356/315

[56] References Cited

U.S. PATENT DOCUMENTS

| | | | |
|---|---|---|---|
| 3,609,364 | 9/1971 | Paine et al. | 340/578 X |
| 3,716,717 | 2/1973 | Scheidweiler et al. | 340/578 X |
| 3,940,753 | 2/1976 | Müller | 340/578 X |
| 4,249,168 | 2/1981 | Muggli | 340/578 |
| 4,280,058 | 7/1981 | Tar | 340/578 X |
| 4,455,487 | 6/1984 | Wendt | 340/578 X |
| 4,472,715 | 9/1984 | Kern et al. | 340/578 X |
| 4,553,031 | 11/1985 | Cholin et al. | 340/578 X |
| 4,691,196 | 9/1987 | Kern et al. | 340/578 |

*Primary Examiner*—Glen R. Swann, III
*Assistant Examiner*—Thomas J. Mullen, Jr.
*Attorney, Agent, or Firm*—W. C. Schubert; V. G. Laslo; A. W. Karambelas

[57] ABSTRACT

Apparatus for sensing the ex(i)stence of a fire and providing a warning, if desired, with improved discrimination against the possibility of false alarms. Dual channel detectors are used, one detector being set to respond to incident radiation having a wavelength in the range of 0.8 to 1.1 microns while the other wavelength range is significantly displaced therefrom, being selected for wavelengths in the range from 14 to 25 microns. Reliability of true signal detection is further improved by the provision of separate flame flicker bandpass filters in the respective channels, these bandpass filters being set for different passbands. Circuits providing ratio discrimination, threshold detectors and delay circuitry are combined with the dual spectrum detectors and disparate flicker frequency filters to achieve improved performance. In addition, the dynamic range of instrument sensitivity is substantially increased by utilizing preamplifiers with wide gain variability controlled by automatic gain control circuits in the dual channel circuitry.

8 Claims, 9 Drawing Sheets

CASE I – FLAMES

CASE II – RANDOM NON-FIRE

CASE III – COHERENT NON-FIRE

DUAL SPECTRUM FREQUENCY RESPONDING FIRE SENSOR

This is a continuation of United States patent application Ser. No. 592,611 filed Mar. 23, 1984, now U.S. Pat. No. 4,691,196.

BACKGROUND OF THE INVENTION

1. Field of the Invention.

This invention relates to fire sensing systems and, more particularly, to such systems particularly designed to discriminate between stimuli from fire and non-fire sources.

2. Description of the Prior Art.

Sensing the presence of the fire by means of photoelectric transducers is a relatively simple task. This becomes more difficult, however, when one must discriminate reliably between stimuli from a natural fire and other heat or light stimuli from a non-fire source. Radiation from the sun, ultraviolet lighting, welders, incandescent sources and the like often present particular problems with respect to false alarms generated in fire sensing systems.

It has been found that improved discrimination can be developed by limiting the spectral response of the photodetectors employed in the system. A plurality of signal channels having different spectral response bands have been employed in a number of prior art systems which utilize different approaches to solving the problem of developing suitable sensitivity for fire sensing while reliably disciminating against non-fire stimuli.

The Cinzori U.S. Pat. No. 3,931,521 discloses a dual-channel fire and explosion detection system which uses a long wavelength radiant energy responsive detection channel and a short wavelength radiant energy responsive channel and imposes a condition of coincident signal detection in order to eliminate the possibility of false triggering. Cinzori et al U.S. Pat. No. 3,825,754 adds to the aforementioned patent disclosure the feature of discriminating between large explosive fires on the one hand and high energy flashes/explosions which cause no fire on the other. U.S. Pat. No. 4,296,324 of Kern and Cinzori discloses a dual spectrum infrared fire sensing system in which a long wavelength channel is responsive to radiant energy in a spectral band greater than about 4 microns of electromagnetic radiation and a short wavelength channel which is responsive to radiant energy in a spectral band less than about 3.5 microns, with at least one of the channels responsive to an atmospheric absorption wavelength which is associated with at least one combustion product of the fire or explosion to be detected. McMenamin, in U.S. Pat. No. 3,665,440, discloses a fire detector utilizing ultraviolet and infrared detectors and a logic system whereby an ultraviolet detection signal is used to suppress the output signal from the infrared detector. Additionally, filters are provided in series with both detectors to respond to fire flicker frequencies of approximately 10 Hz. As a result, an alarm signal is developed only if flickering infrared radiation is present. A threshold circuit is also included to block out low level infrared signals, as from a match or cigarette lighter, and a delay circuit is incorporated to prevent spurious signals of short duration from setting off the alarm.

Muller, in U.S. Pat. No. 3,739,365 and 3,940,753, discloses dual channel detection systems utilizing photoelectric sensors respectively responsive to difficult spectral ranges of incident radiation, the signals from which are filtered for detection of flicker within a frequency range of approximately 5 to 25 Hz. A difference amplifier generates an alarm signal in one of these systems when the signals in the respective channels differ by more than a predetermined amount from a selected value or range of value. In the other system, the output signals from the difference amplifier are applied to a phase comparator with threshold circuitry and delay. An alarm signal is provided only if the input signals are in phase, of amplitude in excess of the threshold level, and of sufficient duration to exceed the preset delay.

The Paine U.S. Pat. No. 3,609,364 utilizes multiple channels specifically for detecting hydrogen fires on board a high altitude rocket with particular attention directed to discriminating against solar radiation and rocket engine plume radiation.

The Muggli U.S. Pat. No. 4,249,168 utilizes dual channels respectively responsive to wavelengths in the range of 4.1 to 4.8 microns and 1.5 to 3 microns. Signals in both channels are subjected to a bandpass filter with a transmission range between 4 and 15 Hz for flame flicker frequency response. Both channels are connected to an AND gate so that coincidence of detection in both channels is required for a fire alarm signal to be developed. Other fire alarm or fire detection systems are disclosed in MacDonald U.S. Pat. No. 3,995,221, Schapira et al U.S. Pat. No. 4,206,454, McMenamin U.S. Pat. No. 3,665,440, Steel et al U.S. Pat. No. 3,122,638 and Krueger U.S. Pat. Nos. 2,722,677 and 2,762,033.

Despite the abundance of systems in the prior art for fire detection, the fact remains that no system has proved to be fully effective in discriminating against false alarms. In those systems where sensitivity is enhanced, there appears to be a concomitant degradation in other performance parameters, such as false alarm immunity. The present invention is directed to techniques for improving small fire detection sensitivity without sacrificing performance in other respects.

SUMMARY OF THE INVENTION

In brief, arrangements in accordance with the present invention involve a pair of detectors, respectively responsive to different spectral ranges, the outputs of which are applied to narrow band signal processing channels having flicker frequency response characteristics in different passbands. In the preferred embodiments of the invention, the long wavelength detector has a spectral response of 14 to 25 microns and the short wavelength detector has a spectral response of 0.8 to 1.1 microns.

Tests have shown that flames have a flicker frequency spectrum regardless of wavelength. Flames that are blown about a great deal by wind or airflow generally have a higher flicker frequency content than flames in still air. Flames in still air generally have a flicker frequency content up to at least 4 Hz.

Non-flame sources are generally characterized either by a continuous (or DC) radiation or, if modulated by some other equipment, by a periodic signal. For example, an electrical heater or a light bulb can have either a continuous (DC) radiation, or a periodic modulated radiation if chopped by an electric fan. Some light sources can also have an alternating (or AC) radiation component that varies with the AC line frequency of 60 or 120 Hz. Other non-flame sources, such as solar radiation, can have what may look like a flicker frequency spectrum due to scintillation of the atmosphere.

The purpose of this invention is to recognize the flicker frequency spectrum of a flame and distinguish it from periodic or modulated non-flame sources. In addition, since the flicker frequency spectral content of a flame is different from the spectral content of scintillating sunlight in both amplitude and frequency spectrum, the present invention also is able to distinguish between the two, even at large flame-to-sensor distances.

High sensitivity fire sensors in accordance with the present invention employ spectral discrimination, flicker frequency discrimination, automatic gain control (AGC) and ratio detection to achieve a wide dynamic range of detectable input stimuli without sacrificing false alarm immunity. The detection of radiation in two spectral regions, relatively widely separated from each other, serves to enhance false alarm immunity. Most false alarm sources have a radiation spectrum which is significantly different from that of flames when observed in these two widely separated regions. Filtering of the modulation on the signals in these two regions into selected frequencies in the flicker frequency spectrum provides additional discrimination against false alarms, most of which have intensity fluctuation spectra which are different from those of the flames of interest. To preserve this discrimination while allowing a wide range of intensity levels, the flicker modulation spectral information is detected wotj a ratiometric method independent of its absolute value. Additional variation in signal levels is made possible by a variable gain stage in the amplifier which precedes signal processing.

The flame flicker signal to be processed can be shown to have a spectrum which changes significantly from one time interval to another. However this flicker spectrum modulates the radiation across the entire radiation spectrum. The signal energy contained at any particular flicker frequency therefore fluctuates, but approximately equally so in both spectral regions for the frequencies used by this technique. Finally, a response delay of one second is incorporated to eliminate the possibility of false alarms due to very brief transients which are not caused by flame flicker.

Flicker spectral discrimination is obtained by passing the flicker signal through more than one narrowband filter in parallel in order to extract the modulation frequency content at the frequencies of the filter. Narrowband here refers to a passband width which is a fraction between 1/10 and ½ of the frequency of maximum gain. A trade-off exists between the frequency resolution (improved by reducing the bandwidth) and response time (decreased by increasing the bandwidth).

Certain variations in the preferred arrangement of the invention may be undertaken for different specific objectives in fire sensing. One particular arrangement provided for maximum sensitivity utilizes two dual narrowband channels as described with the outputs directed to an OR gate and a delay circuit. The channels are identical to each other with the exception of the frequency range of the flame flicker filters at the channel inputs.

In a variation designed for maximum false alarm immunity, a plurality (at least three) of dual narrowband channels are provided in parallel, the outputs of which are coupled to an AND circuit and the delay stage. The dual channels are alike with the exception of the frequency range of the flame flicker filters at their inputs.

Another variation may be employed in which a pair of narrowband channels having different frequency flame flicker filters are operated in parallel with periodic signal detectors. The outputs of the periodic signal detectors are inverted and applied to an AND gate in common with the output signals from the narrowband channels. Thus, upon the detection of a periodic signal from either of the two different spectral detectors, the overall sensing circuit is inhibited. The periodic signal detector is based upon the mathematical process of auto correlation. A radiation signal is continuously compared to itself after various delays extending from zero to 2 seconds. The comparison consists of performing the exclusive OR function on the polarities of the present versus delayed signal samples, i.e., like polarities generate a logical 1 and opposite polarities generate a logical 0. For each delay interval, an average of the exclusive OR outputs is developed. This assortment of averages, each representing the correlation of the signal polarity with itself after a different delay, may be easily processed electronically to determine the degree of periodicity in the incoming signal. For example, a random signal will be just as likely to show equal as opposite polarity when compared to itself after a delay which is long compared to the reciprocal of its bandwidth. The average correlation will therefore be zero. A periodic signal, however, will show identical polarity when delayed by one period. Its correlation will therefore be high after this delay. By testing for a correlation which decays to zero for increasing delays as opposed to one which decays and then rises again, a discrimination may be made between random and periodic signals. Other variations in the combination of periodic signal detectors with narrowband channels are also provided in accordance with the present invention.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
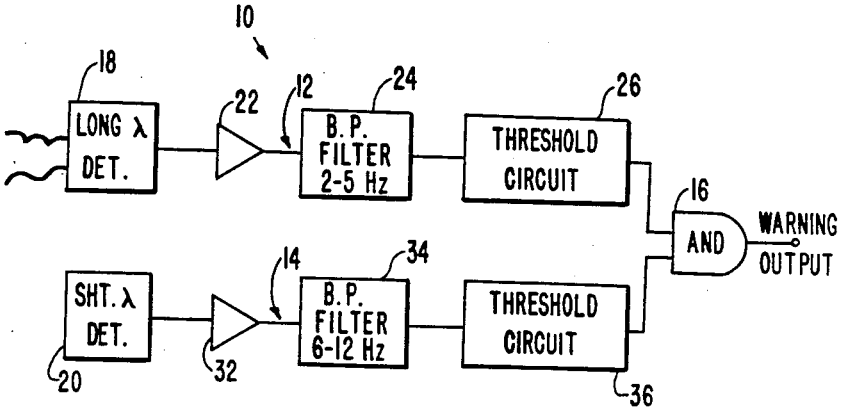
FIG. 1 is a simplified block diagram illustrating one particular arrangement in accordance with the present invention.

FIG. 1 illustrates in block diagram form one basic principle of arrangements in accordance with the present invention. The system 10 of FIG. 1 comprises a pair of separate radiation signal channels 12, 14, each being coupled to a corresponding radiation detector and providing an output to an AND gate 16 which develops an output warning signal for coincident signals at the AND gate input.

The radiation detector 18 of the channel 12 is a long wavelength detector, being responsive to radiation in the range of 7 to 25 microns. The detector 20 in the channel 14 is responsive to radiation in the range of 0.8 to 1.1 microns. Signals from the long wavelength detector 18 are amplified in an amplifier stage 22 and applied to a bandpass filter 24 having a passband in the range of 2 to 5 Hz for flame flicker detection in that frequency range. Signals from the filter 24 are directed to a threshold circuit 26, the output of which is applied to one input of the AND gate 16.

The channel 14 is like the channel 12 except for the spectral response of the short wavelength detector 20 and the frequency range of its bandpass filter 34, which is set for a passband of 6 to 12 Hz to provide a response to flame flicker signals in that frequency range. Channel 14 is completed with an amplifier 32 coupled between the shortwave detector 20 and the bandpass filter 34, and a threshold 36 coupled between the filter 34 and the other input to the AND gate 16.

Figure 1A:
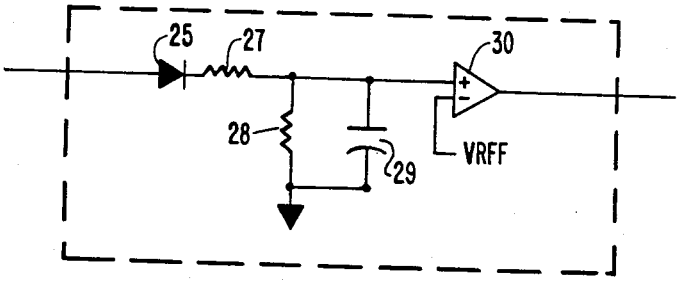
FIG. 1A is a schematic diagram showing circuit details of a portion of the arrangement of FIG. 1.

The threshold circuits 26, 36 have a quick-charge, slow-decay circuit preceding the threshold comparator as shown in FIG. 1A. This requires that multiple cycles of the flicker frequency pass through the filter above the required amplitude set by the comparator. The circuit of FIG. 1A comprises a network at the input of an amplifier 30 which includes a diode 25 in series with a resistor 27 and a parallel network of a resistor 28 and a capacitor 29 tied to ground. Positive polarity signals applied the diode 25 tend to charge the capacitor 29. However, because of the voltage divider provided by the resistors 27, 28, the capacitor does not immediately charge to the full amplitude of the positive pulse. The R-C network of resistor 28 and capacitor 29 has a time constant which exceeds the inter-pulse interval of the applied pulse signals. Therefore, succeeding pulses add to the charge on the capacitor 29 before it can fully discharge, thereby building up the level of voltage applied to the amplifier 30.

Figure 2:
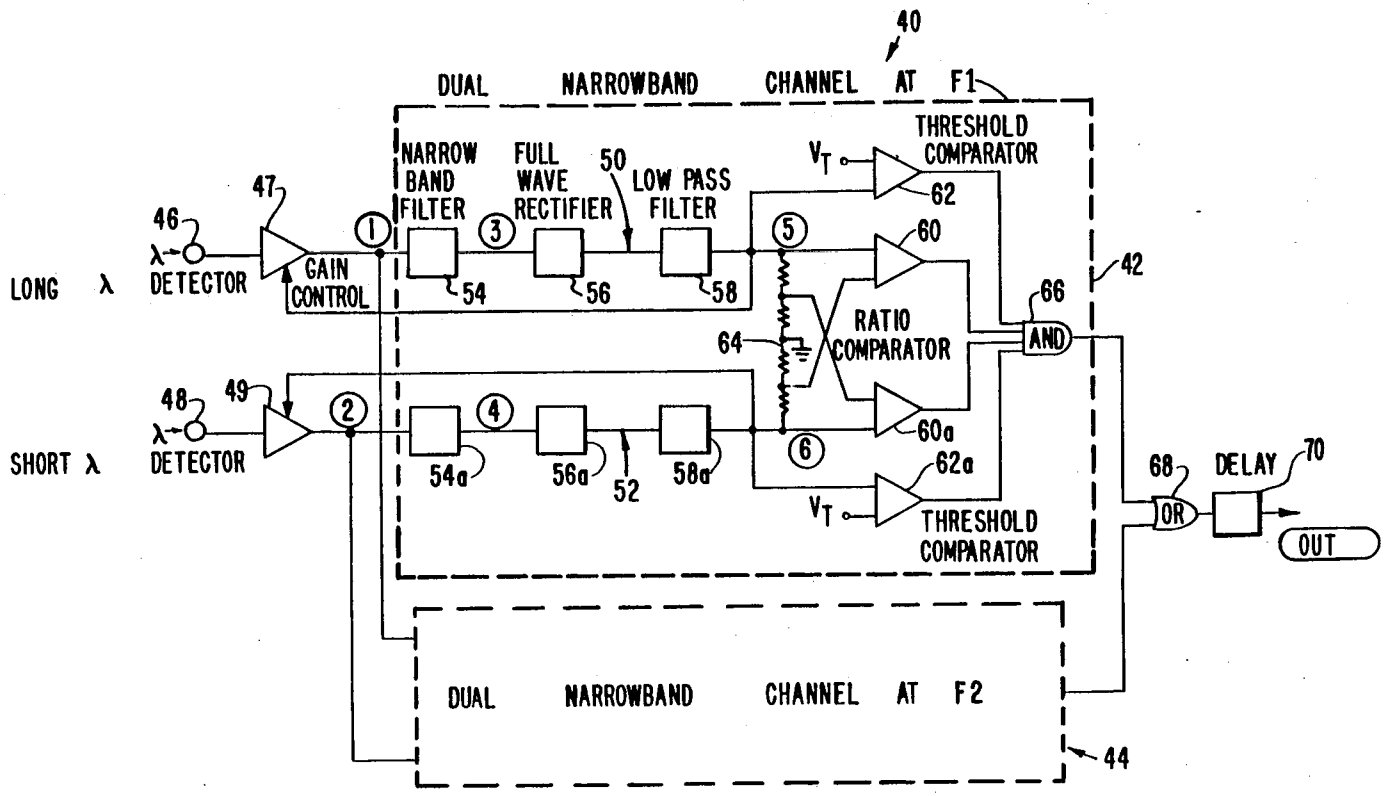
FIG. 2 is a more detailed block and schematic diagram of another arrangement in accordance with the present invention.

The technique of using more than one passband for filtering the flicker frequency spectral distribution may be generalized such that the same wavelength or even the same detector could be used for each of the two bandpass circuits. One such arrangement is depicted in the combination block and schematic diagram of FIG. 2. The arrangement 40 of FIG. 2 is shown comprising a pair of dual narrowband channels 42, 44, both being coupled in like fashion to detector-amplifier circuits having different spectral responses. A long wavelength detector 46, responsive to radiation in the 14–25 micron range, is coupled to an amplifier 47, the output of which is applied to the upper signal path of both channels 42, 44. Similarly, a short wavelength detector 48, responsive to wavelengths in the range of 0.8–1.1 microns, is coupled to an amplifier 49, the output of which is applied to the lower signal path of each of the two channels 42, 44.

The narrowband channel 42 is shown as a symmetrical configuration of two signal paths 50, 52, each comprising narrowband filter 54, a full wave rectifier 56, a low pass filter 58 and a ratio comparator stage 60 coupled in series. Each path also includes a threshold comparator, such as 62 which is coupled in parallel with ratio comparator 60. The two ratio comparators 60, 60*a* of the signal paths 50, 52 are interconnected at their input terminals through an attenuator network 64. The outputs of the two ratio comparators 60, 60*a*, and the two threshold comparators 62, 62*a* are connected as inputs to an AND gate 66, completing the dual narrowband channel 42. The dual narrowband channel 44 is exactly like the channel 42 except that the passbands of the input filters 54, 54*a* are different for channels 42, 44. Also, it will be noted that the variable gain of the amplifiers 47, 49 is controlled from points at the inputs to the two ratio comparators 60, 60*a* in the channel 42.

The detector 46 is a thermopile detector which is responsive to incident radiation within the range of 14–25 microns wavelength over at least a 90° cone angle field of view. The electrical signal from the thermopile detector 46 is amplified by the AC coupled preamplifier 47 having a gain range from 760 to 19,000 as a function of the gain control voltage.

The detector 48 comprises a silicon diode in the photoconductive mode which provides detection of radiation having wavelengths in the 0.8 to 1.1 micron region. Amplifier 49 is a non-inverting operational amplifier utilizing the same gain control circuit as described for the amplifier 47. For the amplifier 49, the overall signal gain is variable between 7 and 174.

The narrowband filters 54, 54*a* may actually comprise one or more individual filter stages for extraction of the flicker spectral information. In one arrangement, these filters incorporate two operational amplifiers each for obtaining three zeros and four poles. An active rectifier, to eliminate diode forward drop, is provided for the rectifiers 56, 56*a*. These are followed by 0.4 Hz two-pole, low-pass smoothing filters to extract the average output of the narrowband filters 54, 54*a*.

The comparison of signals from the two spectral channels is done in a ratiometric manner with the two comparators 60 and 60*a* and the logic gate 66. Each comparator tests one signal to see if it is greater than some fixed proportion of the other, in this case 60%. Both comparators will give true outputs only if the lesser signal is above 60% of the greater, regardless of which is greater. Thus, gate 66 will give a true output only if both signals are above a preset threshold (determined by comparators 62 and 62*a*) and the signal amplitudes are within a ratio of 0.6:1.0 of each other. The exact value for the ratio may be modified to provide a trade-off between false alarm immunity and discimination. A smaller numerical ratio (for example 0.5) would increase the probability of recognizing a fire within a given time interval, but would also increase the possibility that a non-flame source would give a false alarm.

The output signals from the AND gates 66 of the two channels 42, 44 are applied to an OR gate 68 and then fed to delay stage 70. Multiple frequencies of flicker may be compared and an overall fire signal output generated from either a logical AND or a logical OR combination at the gate 68 of the individual ratio comparison outputs. A logical input AND (all individual comparisons valid for an output) minimizes false alarms at the cost of increased probability of missing a fire. Use of a logical OR (any individual comparison valid causes an output) increases the probability of seeing a fire at the cost of increased false alarm probability. Thus, the trade-off between false alarm immunity and detection sensitivity can be made in the circuit arrangement of Fig. 2 by selection of component values in the ratio comparators or by a logic gate configuration change. The delay stage 70 at the output of the gate 68 serves to provide increased false alarm immunity from brief transients of a non-fire nature. The delay time constant of this delay stage 70 is preferably set for approximately one second, so that a fire signal must be present at the output of the gate 68 for that length of time before a finial output is generated from the delay stage 70.

Figure 3A:
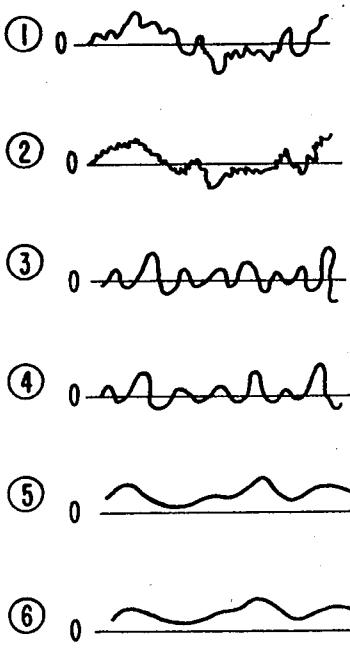
FIGS. 3(A–C) represents a series of waveforms which may be encountered at various points in the diagram shown in FIG. 2 and in the following figures illustrating other particular arrangements in accordance with the present invention for different types of incident radiation.

A number of waveforms are illustrated in FIGS. 3(A–C) corresponding to different numbered points in the circuit arrangement of FIG. 2 for various types of input stimuli. For Case I where the radiation is from an actual flame source, the waveforms of FIG. 3(A) apply. Waveforms 1 and 2, taken from the respective outputs of the amplifiers 47, 49, are essentially random. Waveform 2 exhibits slightly more high frequency content than waveform 1.

Waveforms 3 and 4, present at the outputs of the respective flicker filters 54, 54*a*, exhibit similar envelopes but are not exact duplicates of each other. The feature of these waveforms 3 and 4 is that they are dominated by a small range of frequencies with varying amplitude.

Waveform 5, taken between the lowpass filter 58 and the ratio comparator 60 of the path 50, is a smooth, single polarity waveform which follows the amplitude of waveform 3. Waveform 6, present at the comparable point in signal path 52, is very similar to waveform 5.

Figure 3B:
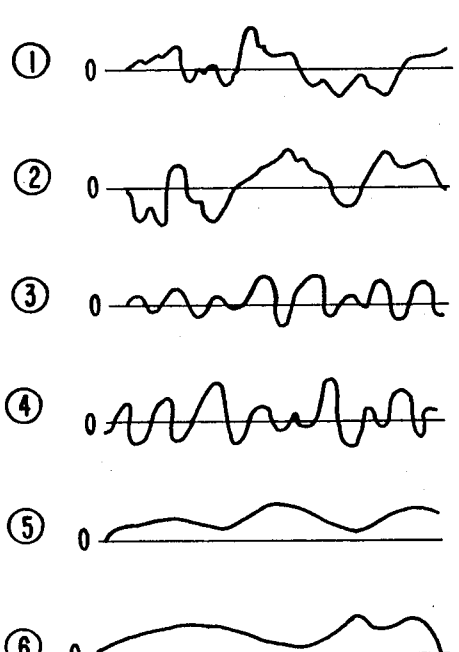

Referring to FIG. 3(B) which shows the waveforms developed from non-fire radiation of a random nature, such as direct sunlight, it will be noted that waveforms 1 and 2 are both nearly random. Waveform 2 is of larger amplitude than waveform 1, due to the more prevalent spectral distribution in the shorter wavelength range, but bears no similarity to waveform 1. In FIG. 3(B) waveforms 3 and 4 are single frequency sinusoids of varying amplitude. However, the variations are different for these two waveforms. For the random non-fire input radiation, waveforms 5 and 6 are slowly varying in amplitude, essentially random and of one polarity. The waveform 5 follows waveform 3; waveform 6 follows the envelope of waveform 4. However, waveform 6 does not follow waveform 5, and therefore the coincidence required to develop a true output from the AND gate 66 is lacking, thus precluding a false alarm for this radiation.

Figure 3C:
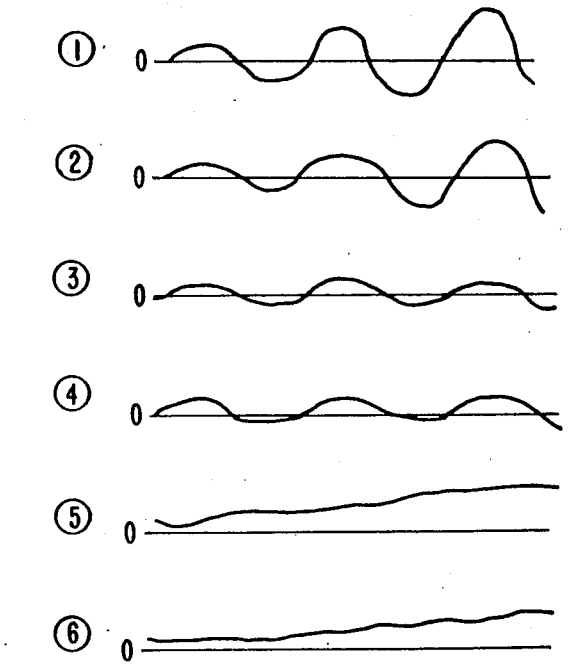

FIG. 3(C) shows the waveforms developed for a third type of input radiation, that from a periodic non-fire signal source such as chopped sunlight. This type of radiation can develop naturally from a fan in front of a sunlit window or from sunlight reflected off the waves on a pond, etc. In this case, waveform 1 is highly repetitious, but is not a pure sinusoid. Waveform 2 is very similar to waveform 1, but has a different amplitude. Waveforms 3 and 4 are smaller amplitude versions of waveforms 1 and 2, respectively. Waveforms 5 and 6 are slowly rising signals which would fail to produce true outputs from the ratio comparators 60, 60*a*.

Figure 4:
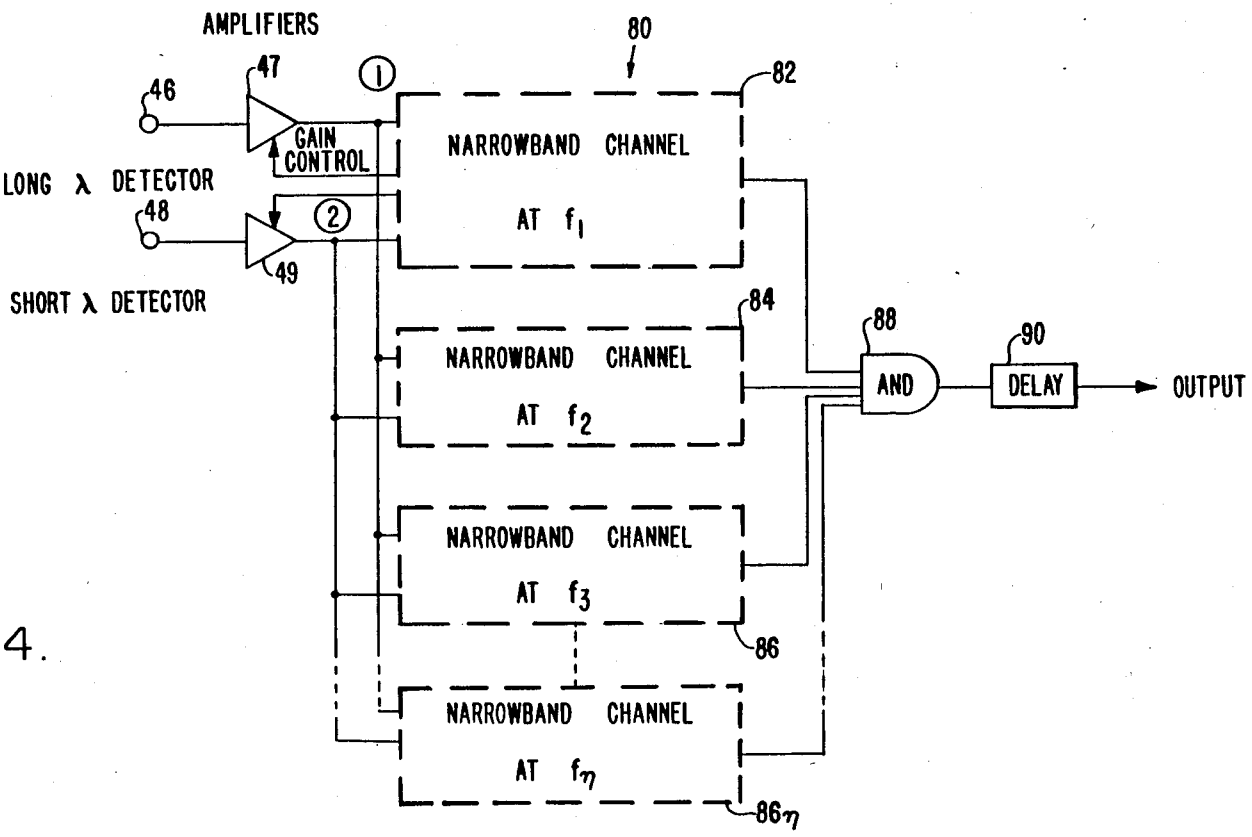
FIG. 4 is a simplified block diagram illustrating a variation of the arrangement of FIG. 2.

The fire sensing system 80 of FIG. 4 is similar to the system 40 of FIG. 2 with the exception that a plurality n of narrowband channel pairs 82, 84, 86, . . . 86*n* are included in parallel instead of the single pair of such channels included in the arrangement 40. The same two detectors and preamplifier stages 46, 47, 48, 49 are used to develop the inputs to all of the narrowband channels 82 et seq. Each of the individual narrowband channels in the arrangement 80 of FIG. 4 is provided with narrowband filters of different passbands at their respective inputs. Also, the outputs of the respective narrowband channels are combined in a single AND gate 88, from which a true output is applied to delay stage 90 to generate the output warning signal after approximately one second delay to guard against false alarms from transient conditions.

Because of the increased number of narrowband channel stages and the requirement that the output from each narrowband channel must be true before a true signal can be passed by the AND gate 88, this arrangement 80 is preferred for those applications where maximum false alarm immunity is desired.

The waveforms of FIGS. 3(A–C) are developed in the arrangement of FIG. 4, just as in the arrangement of FIG. 2. Points 1 and 2 at the output of the amplifier 47, 49 are shown in FIG. 4, corresponding to FIG. 2.

Figure 5:
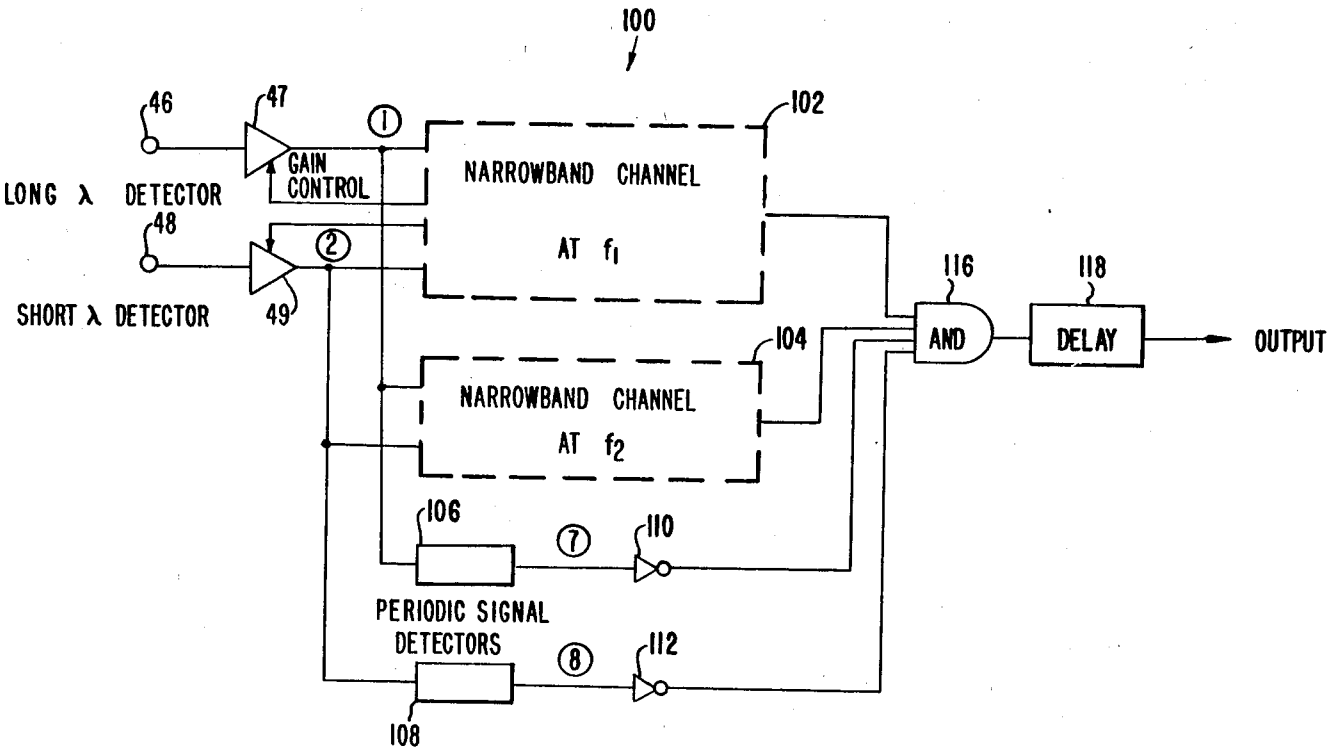
FIG. 5 is a simplified block diagram illustrating another variation of the arrangement of FIG. 2.

FIG. 5 illustrates an arrangement 100 which corresponds to the arrangement 40 of FIG. 2 with the addition of two channels of periodic signal detectors 106, 108 in series with signal inverters 110, 112. The outputs of all four paths in the arrangement 100 of FIG. 5 are coupled to an AND gate 116 which is in series with a delay stage 118. The arrangement 100 of FIG. 5 performs in similar fashion to the arrangement 40 of FIG. 2 with the additional protection afforded by the periodic signal detector paths. It will be noted that the bottom waveform depicted in FIG. 3(C) is designated 7 or 8. That waveform is present at points 7 and 8 at the output of the periodic signal detectors 106, 108 of FIG. 5 when a periodic non-fire source is detected. When the waveform 7 or 8 goes high, the condition is inverted by the applicable inverter 110 or 112 so that one of the inputs to the AND gate 116 is low, thus inhibiting any true output which might be developed from either of narrowband channels 102, 104. Thus, when a periodic signal is present in either the long wavelength detector 46 or the short wavelength detector 48, no fire alarm warning can possibly get through the AND gate 116.

Figure 5A:
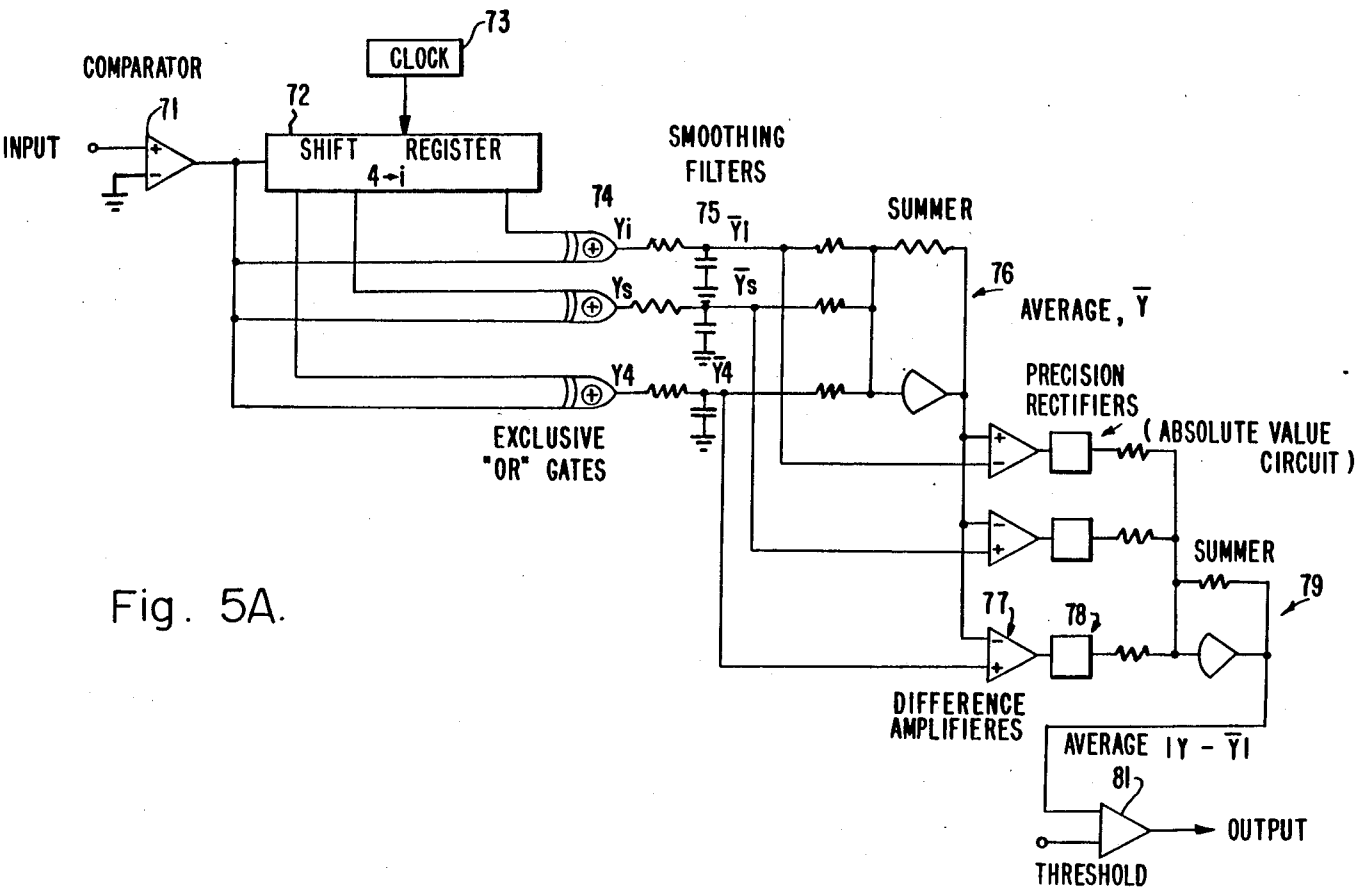
FIG. 5A is a simplified block diagram illustrating an embodiment of the periodic signal detectors in FIG. 5.

In an analog embodiment of the periodic signal detector, FIG. 5A, the input is applied to a comparator 71 coupled to the input of a shift register 72, driven by a clock 73, and a plurality of exclusive OR gates 74 which are also connected to respective outputs of the shift register 72. Each gate 74 output is coupled via a smoothing filter 75 to a summing stage 76 and also to one input of a corresponding difference amplifier 77, the other input of each amplifier 77 being taken from the output of the summing stage 76. Precision rectifiers 78 are connected to apply individual outputs of the difference amplifiers 77 to a second summing amplifier 79 which develops an output signal through a difference amplifier 81. In the circuit of FIG. 5A, the signal polarity is established with the comparator 71 referenced to zero and periodically entered into the shift register 72 (by the clock 73) simultaneously with the shifting of the register by one position. The most recent signal polarity is continuously compared (exclusively OR'd) with each of the shifted polarities. After neglecting the first few averages (up to four), which will always be high because a signal will always be correlated with itself for small delays, the remaining correlation time-averages are evaluated for their spread, i.e., average deviation. This is performed with the aid of a summer 76, absolute value function from precision rectifiers 78 a second summer 79, and a difference amplifier 81. The correlation signals to be processed are first combined and smoothed to establish their composite average. Each individual (smoothed) correlation signal is then subtracted from the composite average and the difference given a positive polarity by means of an absolute value circuit (precision rectifier 81). The sum of these absolute deviations is lastly compared to a fixed reference and a decision results as to whether the incoming signal is periodic or not. Only if the signal shows periodicity will the individual correlation signals show sufficient spread to raise their average deviation above the threshold of the difference amplifier 81.

Figure 5B:
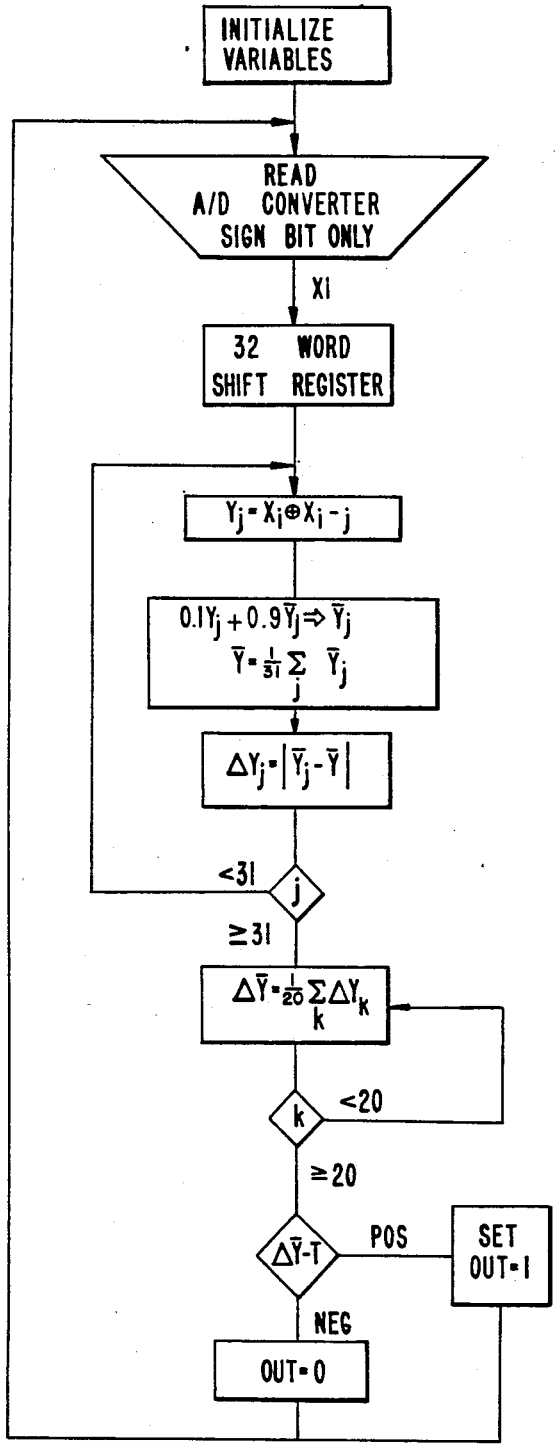
FIG. 5B is a flow chart illustrating how the periodic signal detectors of FIG. 5 might be implemented using a microprocessor.

In a more convenient embodiment, the above processes are performed by a microprocessor, a flow chart for which is shown in FIG. 5B. In the microprocessor embodiment, an analog-to-digital (A/D) converter converts the incoming signal to a form which may be filtered, compared, averaged, etc., all with a fixed program contained in a read only memory (ROM).

The variables used in the flow chart of FIG. 5B are defined as follows:

x(i)=sign bit analog signal sampled at i i=sample variable; x(i)=i(th) sample of x within the range 0 to 31 j=variable to operate on most recent 32 samples of x

Y(j)=exclusive OR of x(i) with previous 31 samples $\overline{Y}$(j)=smoothed Y(j). Analog representation is low pas filter; digital representation takes 90% of previous $\overline{Y}$(j) and adds 10% current Y(j).

$\overline{Y}$=average of last 31 $\overline{Y}$(j)'s

ΔY=spread of Y(j)'s; i.e., absolute difference between $\overline{Y}$(j) and $\overline{Y}$.

ΔY=average of last Y(j)'s.

T=threshold for $\Delta\overline{Y}$ to qualify for periodicity.

In operation, the flow chart of FIG. 5B duplicates the hardware representation of FIG. 5A very closely. The sign bit, x(i), is first obtained from the A/D converter and held in a 32 bit shift register. The i(th) sample of x, x(i), is then exclusively OR'd with the previous 31 samples of x located in the shift register. The result, Y(j), is a digital signal, either 1 or 0.

As a smoothing function, a 32 word memory location, Y(j), is established such that 10% of Y(j) is added to 90% of the $\overline{Y}$(j) remaining from the (i-1)th sample of x. The total is then entered into the $\overline{Y}$(j) memory location instead of the previous $\overline{Y}$(j). As a result, if Y(j) changes from 0 to 1 and remains so for at least 10 samplings of x, $\overline{Y}$(j) will not reach a level of 1 until the 10th sample has been taken.

An average, $\overline{Y}$, is then taken of all $\overline{Y}$(j)'s. From start-up, this $\overline{Y}$ will not reach its steady state value until 32 samples have been taken. From $\overline{Y}$(j) and $\overline{Y}$, the absolute spread $\Delta\overline{Y}$(j) is calculated by taking the absolute value of the difference. In this program, the simple difference was used. A more sophisticated program could use the standard deviation (the root mean square of the differences) with equal effectiveness.

The loop designated j, updates all 32 of the values of $\overline{Y}$(j), ΔY(j) with each new sample x(i). Once the j loop is complete, only the last 20 values of ΔY(j) are used to compute the average spread, $\Delta\overline{Y}$. As mentioned earlier, a signal will always be correlated with itself for small delays. Taking only the last 20 values of $\Delta\overline{Y}$(j) counters that effect.

Finally, the average spread, ΔY, is compared to a threshold T to determine if the spread is sufficient to label the input x a "periodic" signal.

In practice, this autocorrelation scheme is capable of recognizing a periodic signal in the presence of a random signal (such as noise), provided the amplitude of the periodic signal is about a factor of 2 greater than that of the random signal.

Figure 6:
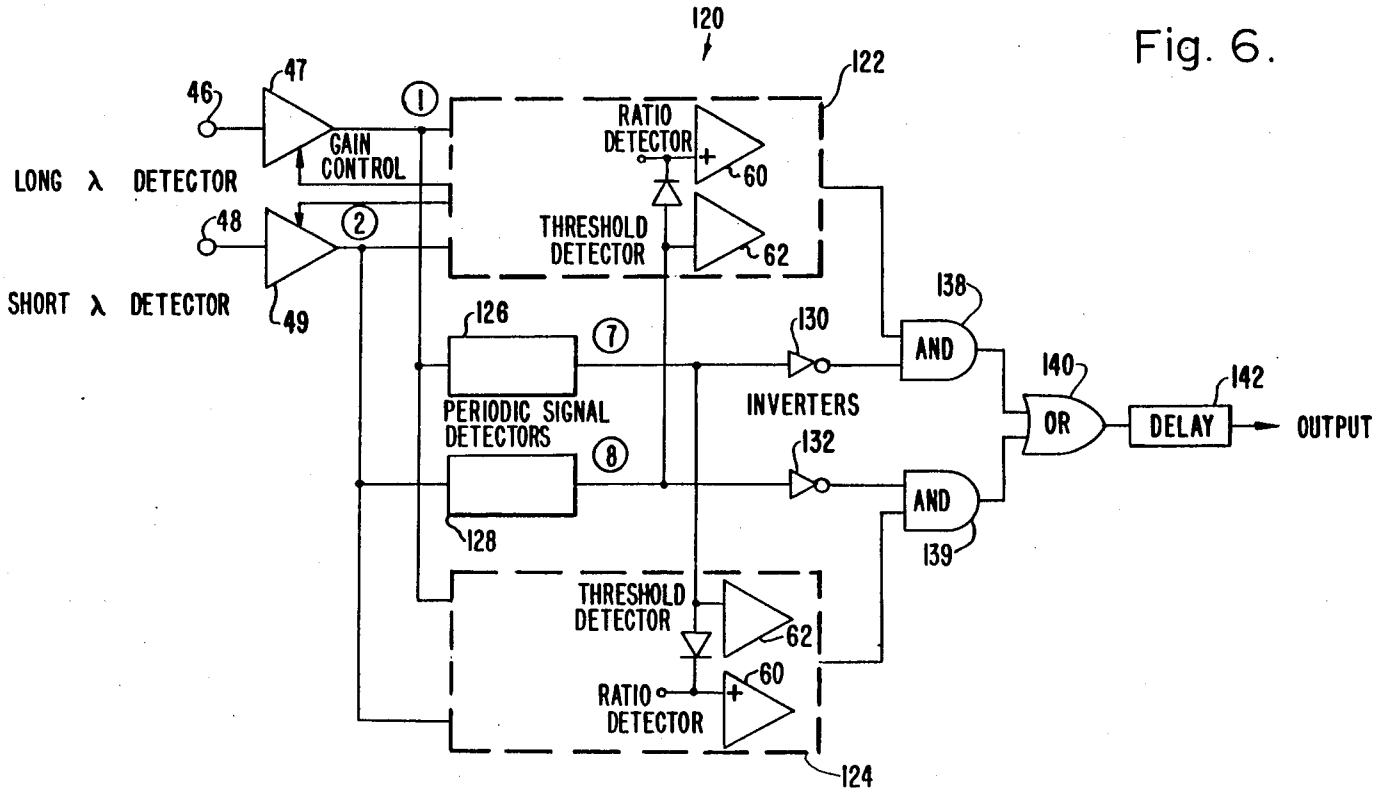
FIG. 6 is a simplified block diagram illustrating a variation of the arrangement of FIG. 5.

FIG. 6 illustrates a variation in the arrangement 120 relative to the arrangement 100 of FIG. 5. Periodic signal detectors 126, 128 (which are similar to 106, 108 of FIG. 5) are shown connected in series with inverters 130, 132 and in conjunction with the narrowband channels 122, 124 as in FIG. 5, except that the outputs of the periodic signal detectors 126, 128 are cross-coupled with a ratio detector 60 and threshold detector 62 in corresponding narrowband channels. All four outputs are applied to AND gates 138, 139 by pairs, and the AND gate outputs are in turn applied to an OR gate 140, the output of which drives the delay stage 142. The arrangement 120 of FIG. 6 provides good sensitivity with enhanced protection against false alarms, because the periodic signal in one range of input radiation wavelengths inhibits the narrowband channel for that radiation detector and places the other narrowband channel into a threshold mode with an elevated threshold. Thus, when a periodic signal in one channel is detected, the increased threshold immediately requires a stronger signal in the other channel to be present for any output signal to be developed.

For example, chopped sunlight would inhibit the short wavelength channel, but not the long wavelength channel. Thus the ratio comparators 60 would be inhibited as would be threshold comparator 62 in channel 124 while threshold comparator 62 in channel 120 would have its threshold raised.

Although the arrangement 100 of FIG. 5 effectively guards against false alarm signals which might otherwise develop in response to periodic radiation, it has the disadvantage that it will not be able to develop any warning signal at all in the presence of a fire when periodic radiation is also present. In other words, the arrangement 100 of FIG. 5 is essentially disabled whenever periodic radiation is present. (That is, chopped sunlight would blind arrangement 100 to a fire that is also present). This disadvantage is overcome to some degree with the arrangement 120 of FIG. 6 which, while disabling the corresponding narrowband channel for the same range of wavelength when a periodic signal is detected in that spectral range, still permits the narrowband channel for the other spectral range to continue functioning, albeit with an increased threshold and thereby a reduced sensitivity.

Figure 7:
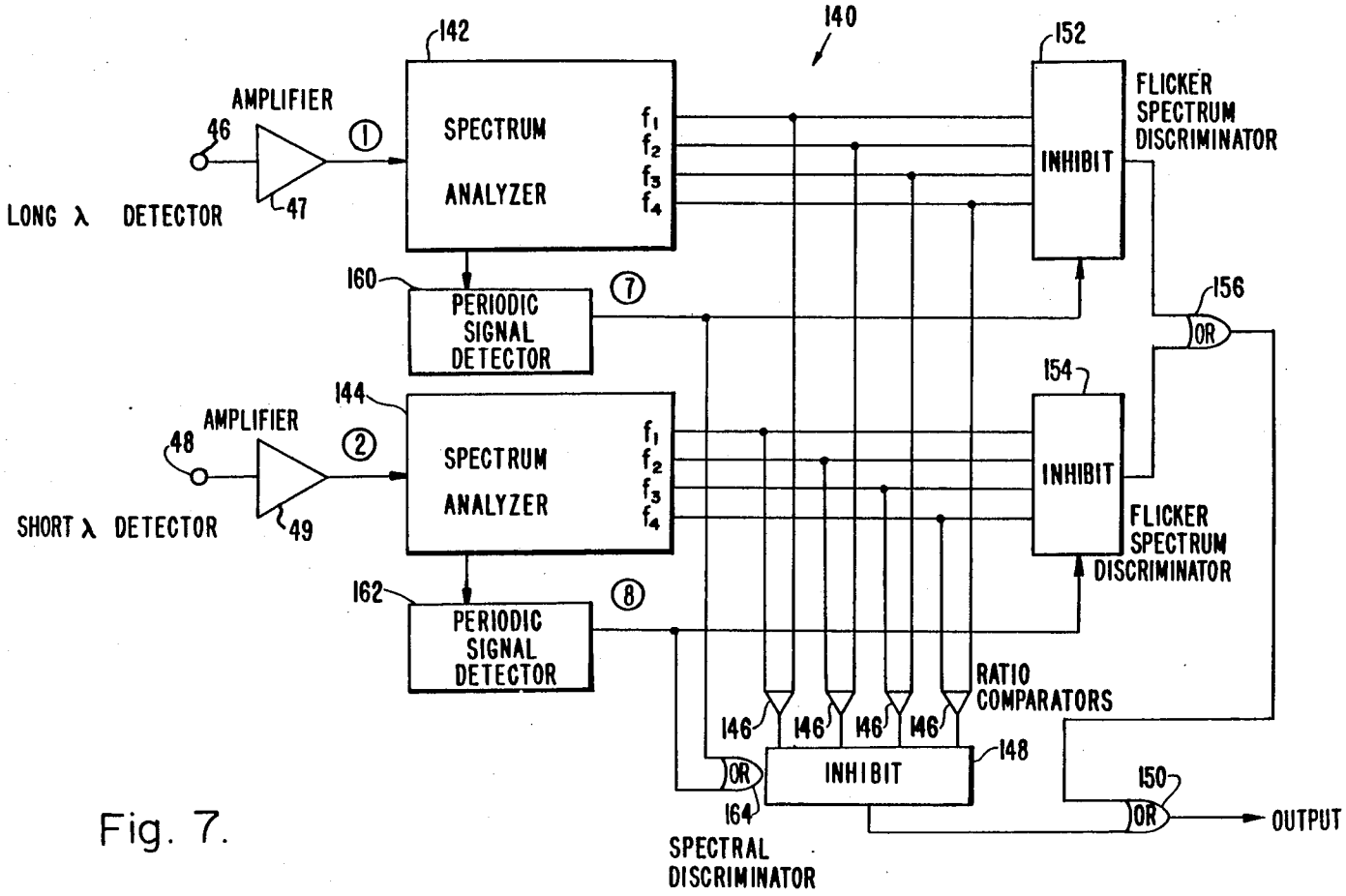
FIG. 7 is a simplified block diagram illustrating another arrangement in accordance with the present invention.

FIG. 7 illustrates another arrangement in accordance with the present invention in block diagram form. The arrangement 140 of FIG. 7 interposes spectrum analyzers 142, 144 in series with the respective long wavelength detector-amplifier 46, 47 and the short wavelength detector-amplifier 48, 49. This arrangement uses the approach of recognizing individual line spectra as opposed to the broad spectral frequency distribution of the arrangements described above. The output of a spectrum analyzer such as 142 will be the provision of signals on one or more of the output lines corresponding to the frequencies f(1)–f(4). Corresponding frequency outputs for the short wavelength channel spectrum analyzer 144 are directed by pairs with those from analyzer 142 to a group of ratio comparators 146, the outputs of which are applied through a combiner stage 148 to a common line directed to an OR gate 150. The combiner stage 148 may be a single OR gate for maximum sensitivity as in arrangement 40 of FIG. 2, or a single AND gate for maximum discrimination as in arrangement 80 of FIG. 4. It may also be a more complex gate array which permits an intermediate level of discrimination (such as any two out of four inputs to produce an output). The output signals from the spectrum analyzers are also applied to corresponding flicker spectrum discriminators 152, 154 which are similar to stages 122, 124 of FIG. 6. The outputs of the flicker spectrum discriminator stages 152, 154 are applied through an OR gate 156, the output of which is fed as the other input to the OR gate 150.

The spectrum analyzers 142, 144 also supply a signal to a periodic signal detector 160 or 162 which is used to inhibit the flicker spectrum discriminator 152 or 154 for the corresponding infrared detector, leaving that part of the circuit operating from the other infrared detector still effective. Periodic signal detectors 160, 162 are similar to periodic signal detectors 106, 108 of FIG. 5. However, it is necessary when periodic radiation is detected to provide a signal to an OR gate 164 at an inhibit input to the combining stage 148, since with one of the channels disabled, the ratio comparators 146 lack dual input signals to provide ratio comparison. If, for example, a periodic signal is detected in the long wavelength branch by detector 46, resulting in an inhibit signal from periodic signal detector 160 which disables that branch, the other branch including the short wavelength detector 48 is still able to function by providing, in the event of detection of fire signals in the short wavelength range, an active signal at the output of the flicker spectrum discriminator 154 which reaches the output through OR gates 156 and 150.

Arrangements in accordance with the present invention as are shown and described hereinabove advantageously provide a fire sensing system with increased sensitivity and improved immunity against false alarms. Some of these arrangements have demonstrated the capability of sensing a five inch diameter pan fire of burning fuel a distance of 30 feet away, as contrasted with the same fire being detectable only four feet away in certain prior art sensing systems. At the same time, this arrangement of the present invention was more immune to the presence of non-fire sources than prior art sensing systems. Improved immunity against periodic background signals, such as chopped sunlight, is afforded in one respect by the separation of the two spectral ranges as contrasted with those detectors of the prior art which have spectral ranges closely adjacent one another. While some of the circuit arrangements may appear cumbersome as shown in the drawings, it is now possible with the advent of modern micro chip technology and very compact microprocessors to reduce the size of such circuitry to an entirely reasonable level.

Although there have been described above specific arrangements of a dual spectrum frequency responding fire sensor in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed:

1. A dual spectrum frequency responding fire sensor comprising:

a first detector for generating electrical signals in response to a range of incident long wavelength radiation;

a second detector for generating electrical signals in response to a range of incident short wavelength radiation substantially displaced from said range of incident long wavelength radiation;

first and second dual path narrowband channel stages coupled in parallel to receive electrical signals generated by said detectors, each of said first and second stages comprising first and second signal paths for processing, respectively, the electrical signals from said first and second detectors; each of said signal paths including a narrowband filter with the passbands of the filters in said first narrowband channel stage being approximately 2 to 5 Hz and the passband of the filters in said second narrowband channel stage being approximately 6 to 12 Hz; and logic means connected to combine the outputs of said stages for developing an output signal upon said detectors receiving radiation from a fire source.

2. The sensor of claim 1 wherein the first detector is responsive to radiation have wavelengths in the range of 14 to 25 microns and the second detector is responsive to radiation having wavelengths in the range of 0.8 to 1.1 microns.

3. The sensor of claim 1 wherein a pair of signal paths within a narrowband channel stage includes a ratio comparator stage for receiving signals passed by the narrowband filters, said ratio comparator stage being interconnected to establish a ratio window within which output signals are generated upon receipt of flicker frequency signals passed by said filters.

4. The sensor of claim 3 wherein each signal path includes a threshold comparator for developing an output signal in response to signals passed by said filter along said path which exceed a predetermined threshold level.

5. The sensor of claim 4 further including logic circuit gates connected to receive output signals from said ratio comparators and said threshold comparators and generate a fire signal in response to predetermined output conditions from said comparators.

6. The sensor of claim 1 further including at least one additional narrowband channel stage in parallel with the first and second narrowband channel stages, each of the additional narrowband channel stages having passbands for the narrowband filters therein which are different from the passbands of the narrowband filters in other narrowband channel stages.

7. The sensor of claim 1 further including periodic signal detecting means coupled to the radiation detectors and selectively connected to inhibit one or more of the narrowband stages upon the detection of periodic signal radiation.

8. A dual spectrum frequency responding fire sensor comprising:

a first detector for generating electrical signals in response to a range of incident long wavelength radiation;

a second detector for generating electrical signals in response to a range of incident short wavelength radiation substantially displaced from said range of incident long wavelength radiation;

first and second dual path narrowband channel stages coupled in parallel to receive electrical signals generated by said detectors, each of said first and second stages comprising first and second signal paths for processing, respectively, the electrical signals from said first and second detectors; each of said signal paths including a narrowband filter having a passband within a predetermined range in which flame flicker frequencies are found, the passbands of the narrowband filters in the signal paths of said first stage being alike but different from and non-overlapping with respect to the passbands of the corresponding narrowband filters in the signal paths of said second stage;

first and second preamplifiers connected respectively in series with said first and second detectors for amplifying electrical signals generated thereby, each of said preamplifiers having a variable gain, and means coupled to the signal paths within one of said channel stages to control the gains of the respective preamplifiers in accordance with signal level in order to increase the maximum sensitivity of the sensor; and logic means connected to combine the outputs of said stages for developing an output signal upon said detectors receiving radiation from a fire source.

* * * * *